US005209785A

United States Patent [19]

Brewe et al.

[11] Patent Number: 5,209,785

[45] Date of Patent: May 11, 1993

[54] NON-CHLORINATED SOLVENT DEWAX PROCESS

[75] Inventors: Susan Brewe, Coventry; Robert W. Dean, North Branford; Mark R. Jaworski, Manchester; Timothy J. Lorette, Colchester; Louis L. Packer, Enfield; John P. Zavodjancik, Columbia, all of Conn.

[73] Assignee: United Technologies Corporation, Hartford, Conn.

[21] Appl. No.: 785,576

[22] Filed: Oct. 30, 1991

[51] Int. Cl.[5] ..... C23G 5/00

[52] U.S. Cl. ..... 134/40; 134/5; 134/26; 208/24

[58] Field of Search ..... 134/40, 19, 5, 16, 13, 134/4, 26, 6; 208/20, 24, 33; 106/270, 271

[56] References Cited

U.S. PATENT DOCUMENTS

| | | | |
|---|---|---|---|
| 2,168,330 | 8/1939 | Ferris | 196/17 |
| 2,254,492 | 9/1941 | Orozco | 134/40 |
| 2,651,655 | 9/1953 | Loughran | 260/450 |
| 2,741,596 | 4/1956 | Luark et al. | 134/40 |
| 2,746,862 | 5/1956 | McDonald | 134/40 |
| 3,003,897 | 10/1961 | Schwartz | 134/40 |
| 4,571,270 | 2/1986 | Sasaki | 134/40 |

FOREIGN PATENT DOCUMENTS 133042 11/1872 United Kingdom .

*Primary Examiner*—Theodore Morris
*Assistant Examiner*—Edward Squillante
*Attorney, Agent, or Firm*—Charles E. Sohl

[57] ABSTRACT

The method involves removing wax from a substrate using a non-chlorinated solvent process. The substrate is dipped in a hot wax bath or heated in an oven to remove substantially all of the wax. The substrate is then submerged in either a single or a series of hot mineral oil baths to remove any remaining wax. The oil is then removed by a semi-aqueous or light organic cleaner. The semi-aqueous cleaner is subsequently removed in an alkaline-base cleaner bath. Following the alkaline-base cleaner is a cleansing with a rinsing solution preferably a countercurrent series of rinses. Finally, the substrate is dried.

4 Claims, No Drawings

NON-CHLORINATED SOLVENT DEWAX PROCESS

DESCRIPTION

1. Technical Field

This invention relates to a dewax process and especially relates to a non-chlorinated solvent dewax process.

2. Background Art

Electroplating is a common industrial technique. Often, the entire substrate is not electroplated and the part of a substrate not to be plated is masked. Commercially, the preferred choice of maskants is a wax material known in the industry as plater's wax.

The plater's wax is typically applied by dipping the substrate to be masked in melted wax. So long as the substrate temperature is below the melting point of the wax, the wax will solidify on the substrate.

Once the electroplating process is complete, the wax is removed from the substrate. One removal technique is a solvent dewax process. Conventionally, solvent dewax processes use chlorinated solvents, because they are non-flammable and effective. The chlorinated solvent is boiled in an enclosure (similar to a vapor degreaser) to cause a vapor layer to form above the solvent. The masked substrate is immersed in this vapor layer and the hot vapor condenses on the cool substrate, rinsing the surface, and removing the wax both by melting and dissolution.

Although chlorinated solvent vapors are a traditional wax removal method, they present many disadvantages. The process produces toxic air emissions, environmentally hazardous waste, and the chlorinated solvents used are suspected carcinogens.

Another removal method is a hot melt process which removes the wax from the substrate by dipping the coated substrate into a bath of melted wax and allowing the substrate to heat up to the temperature of the hot wax. The elevated temperature causes the solid wax to melt off of the substrate. Any remaining wax is typically removed with chlorinated solvent as discussed above. An advantage of this process is that it recovers a substantial portion of the wax, thereby allowing reuse.

A disadvantage of this melt removal process is that residue, such as metals and metal salts, from plating solutions used in the electroplating process, are also removed from the substrate, thereby contaminating the hot wax. Eventually, the hot wax contains sufficient contaminants that it is not suited for further use. Again, disposal is costly and inconvenient.

Accordingly, the present invention teaches an environmentally sound, non-chlorinated solvent dewax process which allows the wax to be reused.

DISCLOSURE OF THE INVENTION

The present invention relates to a dewaxing process for the removal of wax from substrates. The process comprises immersing the substrate in a hot wax bath to melt the majority of the wax from the substrate. The substrate is then dipped in hot mineral oil to remove remaining wax by dissolving it. Once the wax is removed, the substrate is submerged in a semi-aqueous or light organic cleaner to remove any residual mineral oil. The substrate is then rinsed in an alkaline base cleaner to remove any semi-aqueous or light organic cleaner. Finally, any alkaline base cleaner remaining on the substrate is removed with a rinsing solution, and the substrate is dried.

Other features and advantages will be apparent from the specification and claims which illustrate an embodiment of the invention.

BEST MODE FOR CARRYING OUT THE INVENTION

Although the present invention is described with respect to removal of plater's wax, it is not limited thereto. The present invention can be used to remove numerous types of waxes, as well as other water-insoluble coatings or soils, from substrates without employing chlorinated solvents.

Other possible waxes which can be removed utilizing the present invention include natural waxes such as animal, vegetable, and mineral waxes (lanolin, carnauba, and petroleum waxes for example); synthetic waxes such as ethylenic polymers, chlorinated naphthalenes; and hydrocarbon type waxes (machining waxes and forming waxes for example), among others.

Also, this process can be used to remove wax which is located within surface connected internal cavities of substrates. Therefore, "masked substrate" refers to both coated substrates and substrates having wax within internal cavities.

The majority of the wax, typically 90% or more, is removed in the initial step of melting the wax off the substrate. The melting is accomplished by either submerging the substrate in a hot wax bath or heating the substrate in a convention hot air oven or an autoclave oven. The hot wax bath is the preferred melting process since submerging the substrate in the hot wax bath recovers the wax, thereby allowing reuse of the wax for coating additional substrates. Wax removed in the autoclave oven, on the other hand, cannot be readily reused. Autoclave ovens use steam. The steam alters the wax's composition eliminating its usefulness as plater's wax.

It is preferred to add water to the hot wax tank to help prevent contamination of this hot wax with electroplating constituents, such as metal and metal salts, among other contaminants. Up to about 10% of the volume of the hot wax tank can be water, with between about 0.05% and 5% water preferred, with the balance being hot wax.

The hot wax bath is maintained at an operating temperature above the melting point of the wax. For example, plater's wax melting points vary from about 140° F. to about 180° F. depending upon the composition of the wax. Therefore, a plater's wax melt off bath is maintained above 175° F., preferably between about 210° F. and about 250° F. The hot wax is preferably the same wax as that being removed from the substrate.

With the hot wax bath held at operating temperature, the masked substrate is introduced to the tank. The substrate is kept within the hot wax bath for sufficient time to allow the substrate to attain the temperature of the bath, or at least the melting temperature of the wax.

After attaining the temperature of the hot wax bath, the substrate is removed. Typically, depending on the size of the substrate, it is maintained within the hot wax bath for between about 1 minute and about 1 hour. In this and other invention steps, appropriate manipulation of the part both in the tank and after removal will allow wax removal from internal passages and hollows.

Since the hot wax bath generally fails to remove the entire wax coating, the substrate is transferred to a hot mineral oil bath to continue the wax removal process.

Conventional high flash point mineral oils, which are petroleum derivatives, are generally used. These mineral oils include: Chevron Heat Transfer Oil 46 produced by Chevron Oil Company, Richmond, Cal.; Texaterm 46 produced by Texaco Incorporated, Beacon, N.Y.; and U.S. Heat Transfer Oil "C" 46 produced by U.S. Oil Company, East Providence, R.I.

The preferred oil temperature is dependent on the specific wax and mineral oil used. For different types of waxes and mineral oils the appropriate temperature of the oil bath can readily be determined by a skilled artisan. Typically, the hot oil is maintained at temperatures between approximately 210° F. and about 240° F., with a temperature of about 225° F. preferred. Below about 200° F. most waxes will not be efficiently removed from the article, while temperatures above about 250° F. will cause odors and decompose most mineral oils faster with no additional benefits.

Dissolution of wax in the mineral oil eventually results in a wax-oil mixture of higher viscosity, which drains less efficiently from the substrate on removal from the hot oil bath, leaving a larger amount of residue on the substrate, which must then be removed by subsequent cleaning steps. Experience with plater's wax-mineral oil mixtures, both in the laboratory and in manufacturing operations, has shown that this carry-over of wax/oil residue becomes excessive at wax loadings above about 1.0 lb. wax/gallon of oil. Conventional viscosity measurements can be used to determine when the oil should be replaced.

In order to improve process efficiency and ensure complete wax removal, the use of multiple mineral oil baths is preferred. For example, two mineral oil baths can be employed. The first bath is preferably maintained below about 1 lb. wax/gallon of oil while the second is preferably maintained below about 0.2 lbs wax/gallon of oil. These concentrations are preferred because the wax removal time, the required temperature of the mineral oil, and the effectiveness of subsequent operations are affected by the concentration of wax in the mineral oil.

The second mineral oil bath is typically the same mineral oil maintained at the same temperature as the first mineral oil bath. Since the majority of the remaining wax coating is removed in the first mineral oil bath, the second mineral oil bath contains a relatively low wax concentration when similar mineral oil bath volumes are used. As a result, rapid and complete dissolution of any remaining wax coating is ensured. Also ensured is that the residual mineral oil left on the substrate has a low wax concentration.

The preferred method of controlling the wax content of the mineral oil baths is to plumb them together in a countercurrent cascade. Periodic additions of fresh mineral oil are made to the second bath, which overflows into the first bath, displacing heavily wax-loaded oil to a waste collection vessel.

Reduced wax carry over between baths results if the substrate is held over the bath after removal to allow residual mineral oil to drip into the bath from which the substrate has been removed. However, the substrate should not be allowed to cool to the point where the mineral oil and wax residue solidifies.

This series of mineral oil baths removes essentially all of the wax from the substrate but leaves the substrate coated with a film of mineral oil-wax mixture. This oil film is removed with a semi-aqueous or light organic cleaner. Any conventional semi-aqueous or light organic cleaner which is capable of removing mineral oil and is readily removed with water-based solutions can be used. Examples of such cleaners include: Key-Chem 01386 produced by Stuart-Ironsides, Incorporated, Philadelphia, Pa.; Voltkut 30 GW produced by Luscon Industries Corporation, New Haven, Conn.; and others conventionally known in the art.

Since no substantial improvement in cleansing effect has been shown at high temperatures, maintaining the semi-aqueous or light organic cleaner at about ambient temperatures and definitely below about 200° F. is preferred for energy conservation and safety considerations. Operation at ambient conditions can avoid potentially hazardous situations resulting from the low flash point of most semi-aqueous or light organic cleaners.

The oily substrate is typically submerged in the semi-aqueous or organic cleaner for about 10 minutes, although longer times can be used where required. The semi-aqueous or organic cleaner physically dissolves the oil/wax residue on the substrate, diluting it and reducing its viscosity. These changed characteristics of the soil render it removable by subsequent cleaning operations. The semi-aqueous or organic cleaner has a useful capacity of about 1 lb. oil/wax mixture per gallon. This composition is easily measured as an absorbance by either automatic colorimetry or visual color standards. After the same aqueous or light organic cleaning step any residual coating must be removed. The substrate is therefore introduced to a tank containing an alkaline-base cleaner. The alkaline-base cleaner, is typically a conventional water-based cleaner in which the semi-aqueous or organic cleaner is removable. Some such cleaners are: Turco Liquid Sprayeze produced by Turco Products, Westminster, Cal.; Oakite produced by Oakite Products, Inc., Berkley Heights, N.J.; and Daraclean 283 produced by W. R. Grace Company, Lexington, Mass.

The alkaline-base cleaner is preferably maintained at elevated temperatures to accelerate the dissolution of the semi-aqueous cleaner. A skilled artisan can readily determine the optimum temperature at which to maintain the alkaline-base cleaner.

From the alkaline-base cleaner, the substrate is cleansed in rinsing solutions, typically water-based solutions, to remove any residue remaining on the substrate after the alkaline-base cleaner. Although a single rinsing tank can be used, a series of rinsing tanks is preferred, with a triple counter-current flow rinsing tank arrangement especially preferred. A triple counter-current flow arrangement decreases the required flow rate of the rinsing solution in the rinsing tanks, thereby conserving both rinsing solution and energy. Also preferred is to maintain the final rinsing tank contents at an elevated temperature to assist in the drying process which follows the rinses. Typically, final tank temperatures between about 180° F. and 210° F. are maintained.

From the rinsing solution, the substrate can either be dried with an air gun or other conventional means, or allowed to air dry.

In order to improve the removal ability of each of the baths and rinses, to ensure an even temperature and homogeneous consistency throughout the tanks, and to accelerate the cleaning processes, it is preferred that a means for agitating be used. Any conventional means for agitation can be used, such as ultrasonic agitation, air sparging, pump agitation, workpiece movement, and physical mixing, among others.

The following example is given to illustrate the method of dewaxing of the present invention. It is not, however, intended to limit the generally broad scope of the present invention.

EXAMPLE

The following process was used to remove wax from a gas turbine stator. The wax was plater's wax having a melting point of about 175° F.

1. The wax-coated stator was submerged in a tank of plater's wax, maintained at 230° F., for 20 minutes.
2. The stator was then immersed in a tank of Chevron Heat Transfer Oil 46, maintained at 230° F., for 20 minutes.
3. From the mineral oil tank, the stator was moved to a second Chevron Heat Transfer Oil 46 tank, also maintained at 230° F. The stator remained in the tank for 20 minutes.
4. The stator was then cleansed in a tank of Voltkut 30 GW semi-aqueous cleaner for 10 minutes. This cleaner was at ambient temperature and was ultrasonically agitated.
5. The stator was then further cleansed in Turco Sprayeze alkaline-base cleaner for 10 minutes. This cleaner was maintained at 150.F and also ultrasonically agitated.
6. The two cleansing steps were followed by a three-tank counter-current flow water rinse. The third tank was maintained at 200° F., with all three tanks being agitated with air. The stator was immersed in each tank for 5 minutes.
7. The stator was air dried.

The advantages of the present invention can be readily seen. The prior art uses a chlorinated solvent. Chlorinated solvents are environmentally hazardous and are suspected carcinogens. All of the substances used in the present invention are safe for use and readily disposable. None of the substances are environmentally hazardous or suspected carcinogens. Furthermore, since the substrate is initially dipped in a hot wax bath, most of the wax on the substrate is recovered for future use.

It should be understood that the invention is not limited to the substrate or wax embodiment shown and described herein, but that various changes and modifications may be made without departing from the spirit and scope of this novel concept as defined by the following claims.

We claim:

1. A method for dewaxing a wax-coated substrate, which comprises the steps of:

a. melting the wax coating on the wax-coated substrate to remove the wax coating;

b. immersing said dewaxed substrate in at least one mineral oil bath to remove any remaining wax, forming an oily substrate;

c. immersing said oily substrate in semi-aqueous cleaner to remove said mineral oil;

d. immersing said oil free substrate in alkaline-base cleaner to remove said semi-aqueous cleaner and to cleaned said substrate; and e. rinsing said cleaned substrate in at least one rinsing tank with a rinsing solution to remove said alkaline-base cleaner.

2. A method as in claim 1 further including the step of immersing said oily substrate in a second mineral oil bath prior to immersing said oily substrate in said semi-aqueous cleaner.

3. A method as in claim 1 wherein said wax-coated substrate is immersed in a hot wax bath to melt the wax coating.

4. A method as in claim 1 where in up to about 10% of the volume of the wax tank is filled with water.

* * * * *